US008178774B2

(12) United States Patent
Salehi

(10) Patent No.: US 8,178,774 B2
(45) Date of Patent: May 15, 2012

(54) ELECTRIC STRINGED INSTRUMENT WITH INTERCHANGEABLE PICKUP ASSEMBLY AND METHOD FOR UPGRADING ORDINARY ELECTRIC STRINGED INSTRUMENTS

(76) Inventor: Kamran Salehi, Roselle, IL (US)

( * ) Notice: Subject to any disclaimer, the term of this patent is extended or adjusted under 35 U.S.C. 154(b) by 0 days.

(21) Appl. No.: 13/072,543

(22) Filed: Jun. 7, 2011

(65) Prior Publication Data

US 2011/0232465 A1 Sep. 29, 2011

Related U.S. Application Data

(62) Division of application No. 12/343,405, filed on Dec. 23, 2008, now abandoned.

(60) Provisional application No. 61/011,746, filed on Jan. 22, 2008.

(51) Int. Cl.
*G10H 3/18* (2006.01)

(52) U.S. Cl. ..... 84/726; 84/725; 84/723; 84/743

(58) Field of Classification Search ..... 84/723, 84/743, 725–728

See application file for complete search history.

(56) References Cited

U.S. PATENT DOCUMENTS

| | | | |
|---|---|---|---|
| 4,425,831 | A | 1/1984 | Lipman |
| 4,433,603 | A | 2/1984 | Siminoff |
| 4,854,210 | A | 8/1989 | Palazzolo |
| 4,872,386 | A | 10/1989 | Betticare |
| 5,029,511 | A | 7/1991 | Rosendahl |
| 5,252,777 | A | 10/1993 | Allen |
| 5,637,823 | A | 6/1997 | Dodge |
| 6,253,654 | B1 | 7/2001 | Mercurio |

*Primary Examiner* — David S. Warren

(57) ABSTRACT

An electronic instrument comprising at least one receptacle which is configured to insertably receive interchangeable pickup assemblies and which is positioned relative to at least one suspended and taut vibrating element, and whereby the interchangeable pickup assembly is electrically connected and removably secured to the instrument's body via an electric contact.

1 Claim, 5 Drawing Sheets

ELECTRIC STRINGED INSTRUMENT WITH INTERCHANGEABLE PICKUP ASSEMBLY AND METHOD FOR UPGRADING ORDINARY ELECTRIC STRINGED INSTRUMENTS

CROSS-REFERENCE TO RELATED APPLICATIONS

This is a divisional utility application with parent application Ser. No. 12/343,405, with filing date Dec. 23, 2008 now abandoned, which claims priority from U.S. provisional patent application No. 61/011,746 entitled "Electric Stringed Instrument with Interchangeable Pickup Assembly" and filed on Jan. 22, 2008.

The substitute specification contains no new matter.

STATEMENT REGARDING FEDERALLY SPONSORED RESEARCH OR DEVELOPMENT

Not applicable.

BACKGROUND OF THE INVENTION

1. Field of Invention

The present application relates generally to the field of electric stringed instruments. Specifically, the present application is in the field of electrical stringed instruments which may feature an interchangeable pickup assembly or assemblies.

2. Background of the Invention

Ordinary electric stringed instruments feature at least one, permanently installed pickup, which is essentially defined by a magnet surrounded by a coil of thinly gauged wire. Sound is typically created as follows: initially, a vibrating string (usually metal) produces fluctuations in the pickup's magnetic field, thereby producing a distinct electric signal (dependent upon the physical properties of the vibration, e.g., wavelength, frequency, and etc.) in the pickup's coil; next, the electric signal is typically transmitted to a volume and tone control for processing; finally, the results are delivered to an external amplification system which emits sound.

Pickups which are referred to as "active," usually include compact on board electronic devices which function to preamplify the signal to some degree. These electronic devices may include equalization circuits which manipulate the frequency response characteristics of the produced electronic signal. These electronic devices typically receive electricity via an on board battery installed within the body of the electric stringed instrument. Otherwise, varieties of pickups are manufactured, each having their own tonal characteristics.

In the present state of the art, pickups are usually permanently installed on a given electric stringed instrument. As a result, changing a pickup is difficult, time consuming, cumbersome, and requires specific tools, skills and training. In the typical situation, for example, the instruments strings and pick guard must be removed for pickup access, the old pickup wire leads must be severed or unsoldered, and the new pickup wire-leads must be attached or soldered. Accordingly, rather than changing out the pickups, musicians generally must purchase and use multiple electric stringed instruments in order to utilize the varieties of pickups and their associated tonal characteristics.

To avoid the aforementioned problems associated with permanent pickup installation, some have attempted to present interchangeable pickups. However, these attempts have not enjoyed commercial success since the designs hinder operability, decrease aesthetic appearance, or decrease the tonal quality of the instrument. Still, another deficiency is that these attempts result in interchangeable pickups which, as designed, usually do not accommodate existing pickups. Existing pickup designs have been perfected over the years, are well known, and may even produce a signature sound, while an entirely new design may contain imperfection and may not be well known.

For example, an instrument featuring an interchangeable pickup may rely on having a large cavity in the body of the guitar to accommodate an interchangeable pickup module; however, the tonal characteristics of an electric stringed instrument depends on the type and amount of material used in the body. Furthermore, sustaining lengthy notes or chords depends on instrument parts being firmly attached in order to avoid dampening. Examples of attempts which are regarded as inadequate include: U.S. Pat. No. 4,425,831 to Lipman which requires a large contact surface between the pickup unit and the instrument which dampens string vibrations and which makes no provisions for active pickups; U.S. Pat. No. 4,433,603 to Siminoff (large core size changes tonal character and note of instrument); U.S. Pat. No. 4,854,210 to Palazzolo (requires string removal to change the pickup); U.S. Pat. No. 4,872,386 to Betticare (side loading does not allow for size of most existing pickup designs); U.S. Pat. No. 5,029,511 to Rosendahl and U.S. Pat. No. 5,252,777 to Allen (user must loosen strings to insert especially if large pickups used); U.S. Pat. No. 5,637,823 to Dodge (large core segments may change tonal character and reduce the note sustain of instrument); and, U.S. Pat. No. 6,253,654 to Mercurio (large core segments may change tonal character and reduce the note sustain of the instrument).

SUMMARY OF THE INVENTION

Accordingly, it is an object of the present invention to provide an electric stringed instrument featuring at least one interchangeable pickup assembly that may be changed efficiently. More specifically, the invention seeks to provide an interchangeable pickup assembly that can be changed quickly without removing or loosening the instruments strings or pick guard, and without special tools or skill.

It is a further objective of the present invention to provide an electric stringed instrument featuring at least one interchangeable pickup assembly wherein the interchangeable unit does not compromise the tonal integrity of the instrument. More specifically, it is the aim of the invention to provide an interchangeable pickup assembly wherein the vibrations of the instrument strings are not dampened by the interchangeable unit. Also, it is a more specific object of the invention to provide an interchangeable pickup assembly which does not require the displacement of a substantial amount of instrument body material to accommodate the assembly unit so tonal changes are small when compared to permanently installed pickups.

It is yet a further objective of the present invention to provide an electric stringed instrument featuring at least one interchangeable pickup assembly wherein the pickup assembly accommodates new or existing pickup makes, models and designs. Furthermore, it is an object of the present invention to provide an interchangeable assembly that is relatively inexpensive to produce so that a user may have multiple different pickups per instrument.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which.

DETAILED DESCRIPTION OF PREFERRED EMBODIMENTS

Figure 1:
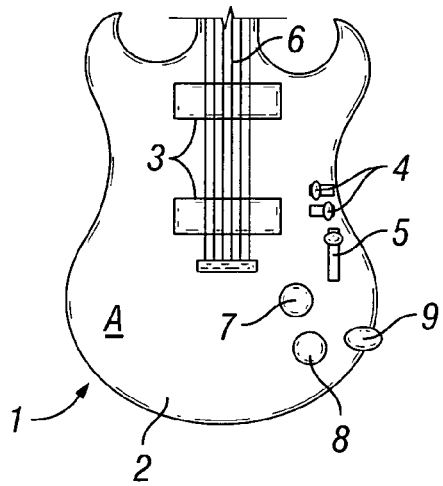
FIG. 1 is a front-view of an embodiment of the electric stringed instrument 1 of the present application.

A pickup is essentially a thinly gauged wire coiled around a magnet. When placed in an ordinary electric stringed instrument, fluctuations in the pickup's magnetic field induce an electric signal within the wire coil which can be processed and translated into sound. Such specifics regarding pickups will be readily understood and readily ascertainable by one skilled in the art. In general then, as depicted in the figures, the electric stringed instrument 1 of the present application features at least one pickup receptacle 3 which is configured to insertably receive interchangeable pickup assemblies 20 and which receptacle 3 is positioned relative to at least one suspended and taut vibrating element 6 (e.g., a string, typically metal), whereby the vibrating element 6, if and when struck, would produce a fluctuation in the magnetic field of a pickup assembly 20 insertably positioned within the pickup receptacle 3. The more specific elements of the electric stringed instrument 1 and interchangeable pickup assembly 20 are depicted in the drawings.

FIG. 1 is a front-view of one embodiment of the electric stringed instrument 1 which depicts: the front portion A of the instrument's 1 body 2 featuring a plurality of strings 6 suspended over at least one open-ended pickup receptacle(s) 3; pickup controls 4 (generally one per receptacle 3) whereby the qualities and characteristics of an installed pickup(s) 30 may be manipulated; pickup selection control 5 whereby a particular installed pickup(s) 30 may be turned on or off; conventional volume and tone knobs (7, 8), which control the volume and tone of the instrument 1 respectively; and, an output jack 9. The functions of the later elements are fully understood by those skilled in the art.

Figure 2:
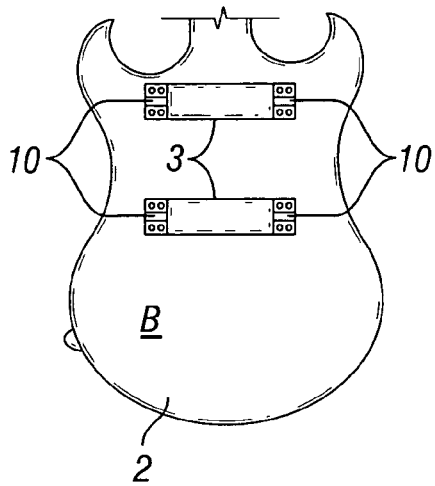
FIG. 2 is a rear-view of the present embodiment of the electric stringed instrument depicted in FIG. 1.

FIG. 2 is a rear-view of the present embodiment of the electric stringed instrument 1 depicted in FIG. 1. FIG. 2 depicts the back portion B of the instrument's 1 body 2 featuring: the receptacles 3 depicted in FIG. 1; cavities 10, adjacently positioned relative the receptacle 3. In the present embodiment, the receptacles 3 are typically defined within the body 2 therebetween the back and front surfaces of the body 2. In other words, the receptacle (s) 3 defines a cut-out or channel through the body 2 between its back B and front A sides (see also FIG. 3). In contrast, the cavities 10, are defined by depressions or ledges in the back B of body 2 surface or in the receptacles' 3 walls (see also FIG. 3) which cavities 10 do not define a full cut-out or channel entirely through the body 2.

Figure 3:
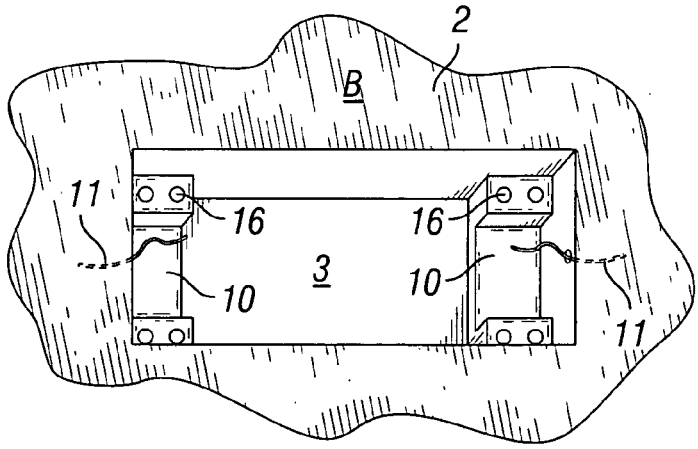
FIG. 3 is a three-dimensional rendering of an receptacle 3 and adjacently situated cavities 10, viewed from a rear perspective of the body 2.

FIG. 3 is a three-dimensional rendering of an receptacle 3 and adjacently situated cavities 10, from a back perspective of the body 2, which further illustrates more specific preferable features of the receptacles 3 and cavities 10. As depicted in the figure, at least one cavity 10 features at least one surface wherein electric wiring 11 is accessible. The electric wiring 11 typically runs internally throughout the body 2, between the particular cavity 10 and the pickup controls 4, the pickup selection control 5, the volume knob 7, the tone knob 8, the output jack 9, and/or a power source. As discussed further below in connection with later figures, a cavity 10 is typically operationally configured to accommodate a socket 13 (see FIG. 4*a*) and usually features at least one surface featuring an attaching or fixing means 16 (see FIG. 4*a*).

Figure 4A:
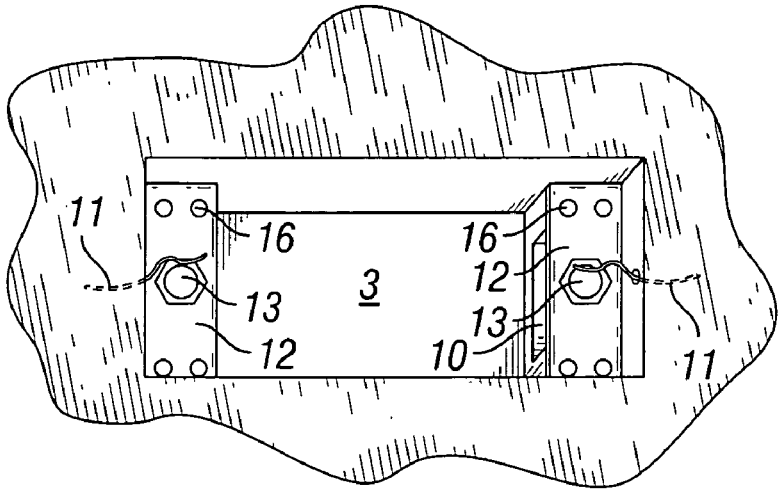
FIG. 4*a* is a three-dimensional rendering of the receptacle 3 and cavities 10 of FIG. 3 with installed base-plate 12 and socket 13.
Figure 4B:
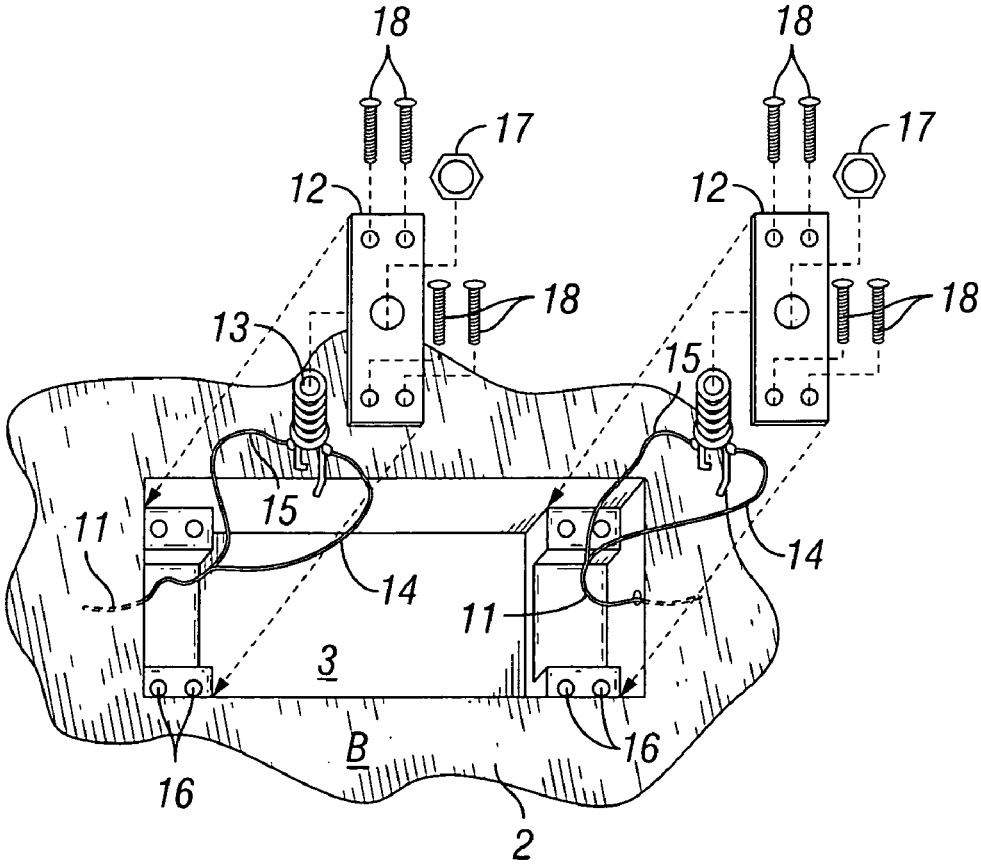
FIG. 4*b* is an exploded three-dimensional view of the receptacle 3, cavities 10, base-plate 12, and socket 13 of FIG. 4*a*.

FIG. 4*a* is a three-dimensional rendering of a receptacle 3 and its associated cavities 10 as previously depicted in FIG. 3. FIG. 4*a* further depicts an installed base-plate 12 and associated socket 13. FIG. 4*b* is an exploded three-dimensional rendering of the receptacle 3, cavities 10, base-plate 12, and socket 13 of FIG. 4*a*. FIG. 4*b* diagrams the installation of the base-plate 12 and socket 13.

Referring to FIG. 4*b*, initially, the electric wiring 11, which features a lead 14 and ground 15, is conductively affixed to the socket 13. As mentioned above, the cavity 10 is configured to accommodate the socket 13, and, accordingly, the socket 12 is generally positioned therein. Next, the socket 13, is usually masculinely inserted through the femininely receiving base-plate 12 and affixed thereto. The present embodiment contemplates affixing the socket 13 to the base-plate 12 via threading the socket 13 into a nut 17 with the base-plate 12 therebetween, however, one skilled in the art will know and appreciate other methods of affixing the socket 13 to the base-plate 12. Such methods include welding, wedging, adhering, and etcetera.

Now referring to FIGS. 3, 4*a* and 4*b*, the base-plate 12 and socket 13 are attached or affixed to the body 2 via the cavity 10 surface which features an attaching or affixing means 16.

The result is the configuration depicted by FIG. 4*a*. Although the present embodiment contemplates screw 18 and screw holes 19 as the attaching or affixing means 16, one skilled in the art will know and appreciate other means for attaching or affixing the base-plate 12 and socket 13 to the instrument's 1 body 2. Such means might include adhesion, wedging, magnetic force, friction, and the like.

Figure 5:
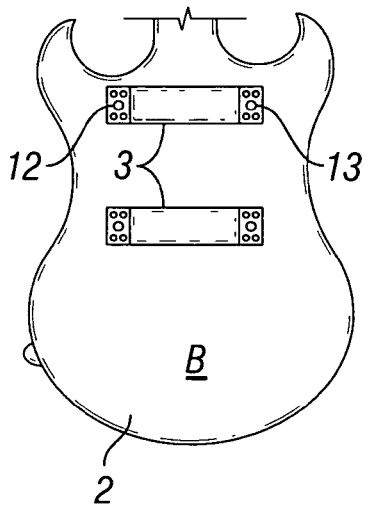
FIG. 5 is a rear-view of the present embodiment of the electric stringed instrument 1, after installation of the socket 13 and base-plate 12.

FIG. 5 is a rear-view of the present embodiment of the electric stringed instrument depicted in FIG. 1 and FIG. 2, after installation of the socket 13 and base-plate 12.

Figure 6:
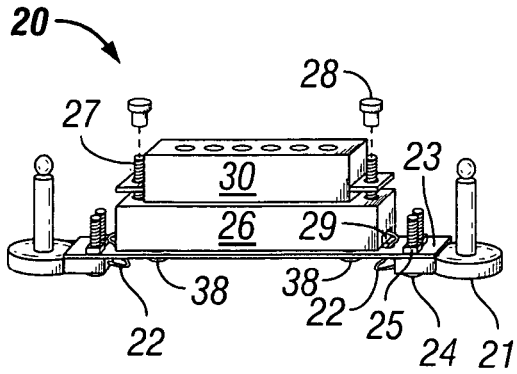
FIG. 6 is a side perspective of a three-dimensional rendering of an interchangeable pickup assembly 20.

FIG. 6 is a side perspective of a three-dimensional rendering of an interchangeable pickup assembly 20 which features: at least one plug 21 having an associated electrical output cable 22 (a suitable type plug might be a standards ¼ inch phono plug, or similar shaped plug); a frame bar 23; a means for affixing the plug 21 to the frame bar 23 (screw 24 and nut 25); a pickup spacer 26, which features an outer perimeter which approximately matches the perimeter of the receptacle 3; a means for associating the pickup spacer 26 with the frame bar 23 (screw 38); a channel 29 running through the frame bar 23 and/or the pickup spacer 26 to terminating at the upper surface of the pickup spacer 26 and configured to accommodate the output cable 22 from the plug 21; an installed pickup 30; and, a means for installing the pickup 30 (screw 27 and nut 28). The pickup 30 is generally any new or traditional type of pickup. The pickup 30 is typically installed via making an electrical connection with the output cables 22 accessible from the outlet of channel 25, and is associated with the assembly 20 by screw 27 and nut 28.

Figure 7:
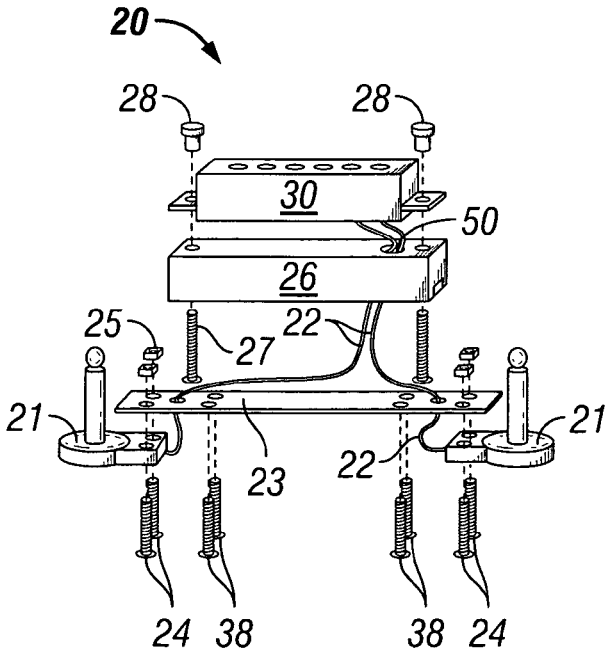
FIG. 7 is an exploded view of the interchangeable pickup assembly 20 of FIG. 6 with installed pickup 30, which diagrams the assembly thereof.

FIG. 7 is an exploded view of the interchangeable pickup assembly 20, which diagrams the assembly thereof. Initially, the plug (s) 21 is (are) affixed to the frame bar 23 whereby (as discussed below in connection below with the depiction in FIG. 8) the relative proximate relationship between the plug 21 and the base frame 23 is substantially similar to the proximate relationship between the cavities 10 and the receptacle 3. While the present embodiment contemplates using a screw 24 and nut 25 as a means for affixing the plug 21 to the frame bar 23, one skilled in the art will know and appreciate other means. Such means might include welding, adhesion, wedging, magnetic force, friction, and the like. Next, the output cables 22 are strung through the frame bar 23 and the pickup spacer 26 via the channel 29 and the pickup 30 is installed therewith, at the channel outlet 50. Next, the pickup spacer 26 and the pickup 30 are stacked, and screw 27 is driven through the two components and held in place by nut 28. Finally, the pickup spacer 26 and pickup are positioned atop the frame bar 23 where the screw 38 is driven through the frame bar 23 into the pickup spacer 26 to complete the assembly 20.

Figure 8:
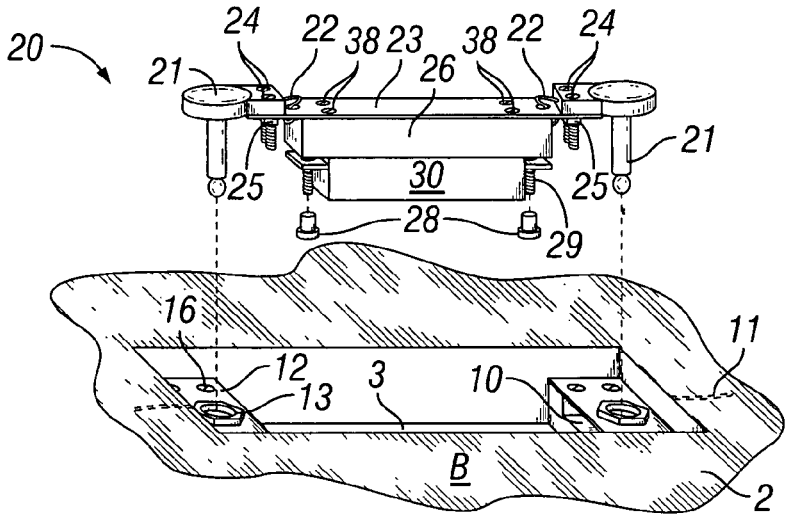
FIG. 8 is a perspective of the receptacle 3 depicted in FIG. 4*a* and the interchangeable pickup assembly 20 which depicts the insertion of the interchangeable pickup assembly 20 into the receptacle 3.
Figure 9:
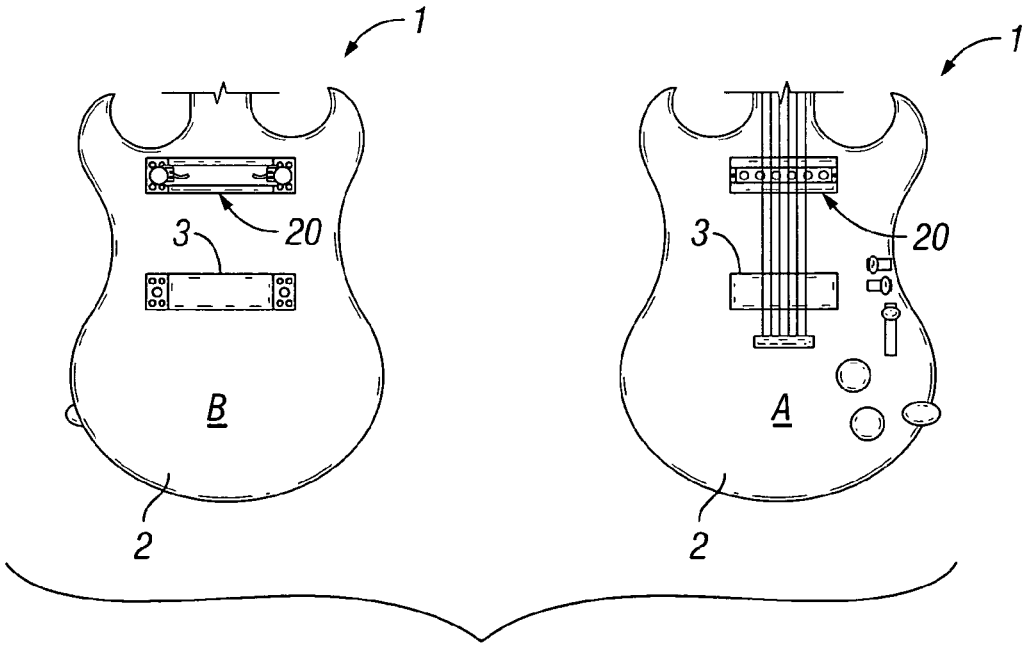
FIG. 9 fully depicts the front A and back B sides of the instrument 1 with the assembly 20 inserted into the receptacle 3.

FIG. 8 is a perspective of the receptacle 3 depicted in FIG. 4*a* and the interchangeable pickup assembly 20, which figure depicts the insertion of the interchangeable pickup assembly 20 into the receptacle 3. The assembly 20 is generally fed into the back end of the receptacle 3, pickup 30 first, whereby the pickup spacer 26 is aligned with the approximately matched perimeter of the receptacle 3 and the plug (s) 21 is (are) aligned with the socket 13. The assembly is fed further into the receptacle 3, the pickup spacer typically sliding along the approximately matched perimeter of the receptacle 3, until the plug 21 has entered the socket and created an electrical connection therebetween. Preferably, the plug 21/socket 13 connection is not solely an electrical contact, but also is a primary means of physically securing an inserted assembly 20 to the instrument 1. As such, the assembly 20 may generally be removed simply by unplugging the plug 21 from the socket and sliding the assembly 20 from the receptacle 3. Insertion of the assembly 20 generally results in the positioning of the pickup 30 at the front end of the receptacle 3, below at least one of the suspended and strings 6. The distance between the strings 6 and the pickup 30, when installed in the receptacle 3, depend on the thickness of the pickup spacer 26. Accordingly, to manipulate such distance, thicker or thinner pickup spacers 26 may be used. Alternatively, a plurality of pickup spacers 26 can be stacked to decrease the distance, and removed to increase the distance. FIG. 9 fully depicts the front A and back B side of the instrument 1 with the assembly 20 inserted into the receptacle 3, as taught by FIG. 8. Removal of an inserted assembly is accomplished by unplugging the plug 21 from the socket 13 and sliding the assembly out of the back side of the body 2 in the reverse manner described above for insertion. Such removal typically requires minimal effort since disengaging the plug 21 from the socket 13 releases a primary means for securing the assembly 20 to the instrument 1.

Figure 10A:
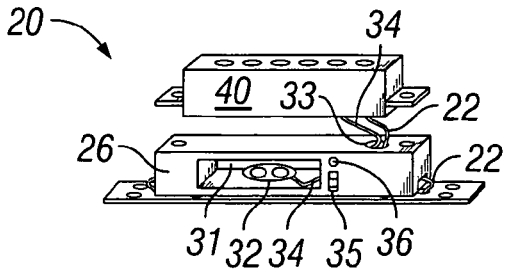
FIG. 10*a* is a side perspective of a three-dimensional rendering of an alternate embodiment of the pickup spacer 26 configured to accommodate active pickups 40.
Figure 10B:
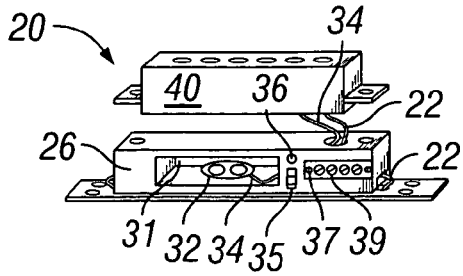
FIG. 10*b* depicts the pickup spacer of FIG. 10*a* with the additional feature of a miniature circuit board 37.

FIG. 10*a* is a three-dimensional rendering of an alternate embodiment of the pickup spacer 26 configured to accommodate active pickups 40 (like a conventional hum-bucker active pickup) which spacer 26 features: at least one battery cavity 31 wherein is accessible a battery connector 32; a power channel 33 running from the battery cavity 31 to the upper surface of the pickup spacer 26. A power cord 34 running between the battery connector 32 and the channel 33 outlet at the surface of the pickup spacer 26, and connected to the active pickup 40; a power switch 35 to deny/permit electricity to flow across the power chord 34; a light emitting diode (LED) 36 displayed on the surface of the pickup spacer 26 and electrically connected to the power cord 34 whereby the LED 36 illuminates if the power switch 35 is positioned to allow electrical flow. FIG. 10*b* depicts the pickup spacer of FIG. 10*a* with the additional feature of a miniature circuit board 37 which consists of miniature adjustment knobs 39 for adjusting the likes of volume, bass, mid, and treble. One skilled in the art will readily appreciate other knobs and functions of the miniature circuit board 37. Generally, such pickup spacers 26 will be used in conjunction with single coil type pickups 30 whereby the benefits of an active pickup 40 can be added to a passive pickup.

Figure 11A:
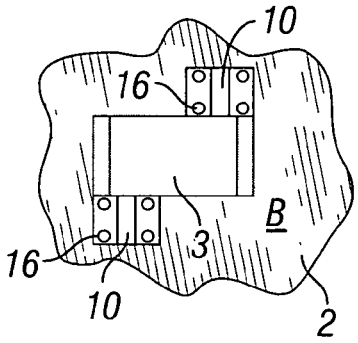
FIG. 11*a* depicts an alternate positioning of the cavities 10 relative to the receptacle 3, as viewed from a back perspective on an electric stringed instrument 1 body 2.
Figure 11B:
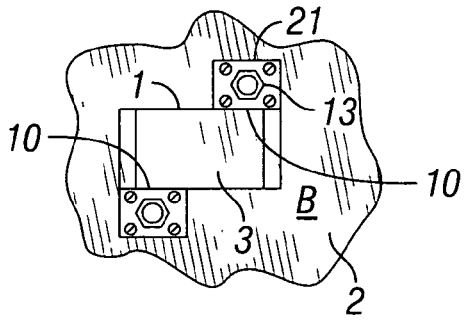
FIG. 11*b* depicts the cavities 10 and receptacle 3 of FIG. 11*a* with the base-plate 12 and socket 13 installed.
Figure 11C:
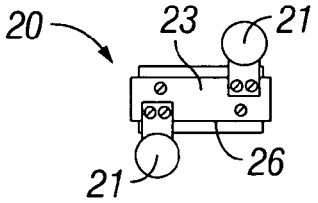
FIG. 11*c* is a bottom perspective of an alternate embodiment of the interchangeable pickup assembly.
Figure 11D:
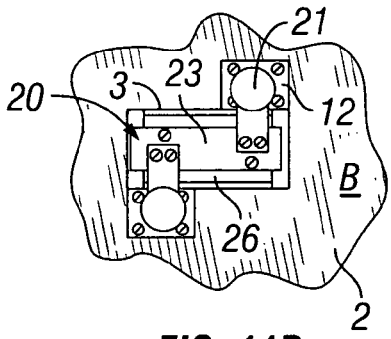
FIG. 11*d* is a back perspective of the interchangeable pickup assembly 20 of FIG. 11*c* inserted into the receptacle 3 of FIG. 11*b*.

FIG. 11*a* depicts an alternate positioning of the cavities 11 relative to the receptacle 3, as viewed from the back B of a guitar body 2. FIG. 11*b* depicts the cavities 10 and receptacle 3 of FIG. 11*a* with the base-plate 12 and socket 13 installed as described above. FIG. 11*c* is a bottom perspective of an alternate embodiment of the interchangeable pickup assembly, wherein the plugs 21 are positioned in substantially the same relative position to the base plate 23 as the cavities 10 of FIG. 11*a* and 11*b* are positioned relative to the receptacle 3 of the same figures. FIG. 11*d* is a back perspective of the interchangeable pickup assembly 20 inserted into the receptacle 3 of FIG. 11*a* and 11*b* with the plugs 21 engaging the sockets 13, which is accomplished in the manner described above.

The electric stringed instrument 1 with interchangeable pickup assemblies 20 may be fabricated directly or ordinary electric stringed instruments may be upgraded according to the following method. First, the permanently installed pickup is usually removed in a manner known to those skilled in the art whereby internal wiring 11 is preserved. Second, a cut-out from the ordinary instrument's body 2 is typically created behind the ordinary instrument's strings 6 whereby an open-ended pickup receptacle 3 is created, similar to that depicted in FIG. 3 or 11*a*. Third, at least one cavity 10 is bored adjacent to the receptacle 3 whereby internal wiring 11 is exposed at the cavity 10. Fourth, the socket 13 and base-plate 12 are installed as described above. Fifth, an interchangeable pickup assembly 21 is fabricated as discussed above, whereby the plug (s) 21 is positioned on the assembly 20 in the same relative proximate position as the cavity 10 to the receptacle 3.

Figure 12:
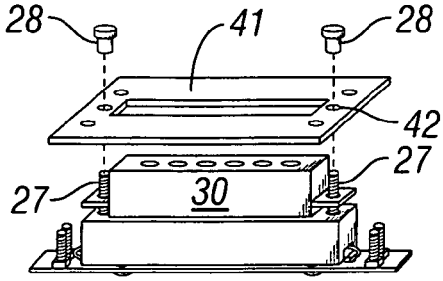
FIG. 12 illustrates the use of a pickup ring 41 in connection with an electric stringed instrument 1 featuring interchangeable pickup assemblies.

FIG. 12 illustrates the use of a pickup ring 41 in connection with either an electric stringed instrument 1 featuring interchangeable pickup assemblies, or an original electric stringed instrument 1 which has been upgraded as described above. A pickup ring 41 is generally ornamental and is generally installed on the front surface of the guitar body 2 between the taut suspended vibrating members 6 and the pickup 30 itself. In the present embodiment, pickup rings 41 may be placed over/around the front end of the receptacle 3. Using a pickup ring 41 may also add stability to an inserted interchangeable pickup assembly 20 during instrument 1 use since, the screw 27 may be passed through the underside of the pickup ring 41 at orifice 42 to meet the nut on the upper-side whereby the assembly 20 is affixed to the pickup ring 41. Ordinary pickup rings 41 are typically suitable for such use without modification since, generally pickup rings 41 feature at least one orifice 42 designed for accessing adjustments components of pickups installed on ordinary electric stringed instruments.

In general summation, the electric stringed instrument 1 of the present application features at least one pickup receptacle 3 which is configured to insertably receive interchangeable pickup assemblies 20 and which is positioned relative to at least one string 6, whereby the vibrating element 6, if and when struck, would produce a fluctuation in the magnetic field of a pickup assembly 20 insertably positioned within the pickup receptacle 3. The primary means for physically securing the assembly 20 to the instrument is via the electrical connection between the assembly 20 and the instrument 1.

The invention claimed is:

1. An electronic musical instrument comprising:

at least one receptacle cavity, extending from back to the front of the instrument, configured whereby at least one string positioned proximately thereto;

at least two electric sockets; and, at least one interchangeable pickup assembly, the said receptacle cavity in the body of the instrument sized and shaped to allow insertion of the interchangeable pickup assembly into the instrument body from the back of the instrument;

the said pickup assembly featuring at least one pickup, and at least two electric plugs electrically connected to the pickup and positioned symmetrically at the two opposing sides of the said pickup, oriented such that the insertion tip of the plug is pointed towards the top side of the said pickup, and configured to engage said socket, and fastened to opposing sides of a base frame and at least one pickup spacer, optionally including an electricity source and a miniature circuit board for the said pickup, said spacer having an outer perimeter smaller than the inner dimensions of said receptacle, and positioned between the said pickup and said base frame, so that the thickness of the said pickup spacer determines the proximity of said pickup to said vibrating string, with said interchangeable pickup assembly operationally configured to electively insert into and withdraw from said receptacle cavity, whereby said pickup is functionally positioned proximate to said string and wherein said engagement between said socket and said plug is the means for physically securing said interchangeable pickup assembly to said electrical instrument, as well as establishing electrical connection between them.

* * * * *